United States Patent [19]

Haug

[11] Patent Number: 4,799,518

[45] Date of Patent: Jan. 24, 1989

[54] MACHINE FOR SEQUENTIAL MANUFACTURE OF INCANDESCENT LAMP FILAMENTS

[75] Inventor: Joachim Haug, Herbrechtingen, Fed. Rep. of Germany

[73] Assignee: Patent-Treuhand Gesellschaft fur elektrische Gluhlampen mbH, Munich, Fed. Rep. of Germany

[21] Appl. No.: 96,938

[22] Filed: Sep. 15, 1987

[30] Foreign Application Priority Data

Sep. 23, 1986 [DE] Fed. Rep. of Germany ..... 3632262

[51] Int. Cl.[4] ..... B21F 3/04

[52] U.S. Cl. ..... 140/71.5

[58] Field of Search ..... 72/66, 135, 138, 142, 72/143, 145; 140/71.5, 71 C

[56] References Cited

U.S. PATENT DOCUMENTS

| | | | |
|---|---|---|---|
| 2,192,260 | 3/1940 | Fisher | 72/138 |
| 3,322,164 | 5/1967 | Lindsay | 140/71.5 |
| 3,605,822 | 9/1971 | Noguchi et al. | 140/71.5 |
| 4,408,639 | 10/1983 | Hayama et al. | 140/71.5 |

FOREIGN PATENT DOCUMENTS

| | | | |
|---|---|---|---|
| 865896 | 4/1961 | United Kingdom | 140/71.5 |

*Primary Examiner*—Lowell A. Larson

*Attorney, Agent, or Firm*—Frishauf, Holtz, Goodman & Woodward

[57] ABSTRACT

To make a series of spiral filament sections (6) joined by separating zone (5) extending essentially longitudinally of the core wire (4) which, after the filaments have been made and severed in the separating zones, is etched out of the spiral sections. To form the separating zones, a pincer system (7) having two jaws engage the core wire just after a filament section has been wrapped by a winding head (1) about the core wire. The pincer system has jaws which are sufficiently long, or have jaw elements (10,11) spaced from each other by a distance (d) corresponding to the length of the separating zone. Upon subsequent rotation of the winding head, a next spiral filament section (6) will be wrapped about the core wire, spaced from the preceding one by the spacing (d) of the jaw elements (10,11) or the length of the jaws (8). The pincer system travels longitudinally with the core wire upon formation of the spiral filament section. Opening and closing of the jaws is controlled in timed relation to operation of the winding head and wrapping of the filament sections.

26 Claims, 5 Drawing Sheets

MACHINE FOR SEQUENTIAL MANUFACTURE OF INCANDESCENT LAMP FILAMENTS

Reference to related publication, British Patent No. 865,896, published Apr. 19, 1961.

The present invention relates to a machine to make incandescent lamp filaments, in which filament material is wrapped about a mandrel or core wire, which is pulled longitudinally, and in which, between sequential filaments, an essentially longitudinal or straight separating zone extends. The mandrel or core wire, after having the filament sections, with the intervening separating zones placed thereon, is then etched away to leave the filaments with straight connecting ends.

Background

British Patent No. 865,896 (to which German Patent No. 1 148 326 corresponds) describes a typical winding machine, well known and suitable to make spirally twisted or coiled filaments, in which the spirally twisted filament sections are joined by straight separating zones or separating sections. The separating sections, in this prior art machine, are made by placing the rotatable pin in frictional engagement with the core wire. The core wire is pulled longitudinally, and the pin is rotatable about pin journals or bearings. Two rollers are located, and extending in parallel to the pin and spaced therefrom by some distance. After formation of the spiral filament sections, and when a separating zone is to be made, the rollers frictionally engage the core wire, above and below the wire diameter. The difference between the pin and the rollers determines the length of the separating zone. During winding of the spiral filament sections, the upper roller, that is, the roller on the upper side of the core wire, is lifted off the core wire. In this arrangement, neither the pin nor the rollers move longitudinally along with the core wire.

This arrangement works well and is particularly suitable for filament wires of diameters which are greater than 0.2 mm. When filament wires of smaller diameters are to be handled, for example of about 0.05 mm to about 0.15 mm, it has been found that wound incandescent filaments made by machines of this type do not have the requisite quality, and reproducibility. The frictional engagement between the core wire and the roller or the pin, respectively, becomes less and less as the diameter of the filament wire decreases.

A high reject rate has been experienced. It has been found that the thin filament wire has a tendency to slip between the core wire and the roller, or the pin, respectively, so that the separating zones will be of non-uniform length. When using filament wires which are even thinner, that is, filament wires having diameters which are markedly below 0.05 mm, it was no longer possible to manufacture pins and rollers small enough to handle such tiny thin wires.

The Invention

It is an object to provide a filament manufacturing machine, which makes sequential spiral filament sections, wrapped about a mandrel or core wire, with intervening separating zones which extend essentially longitudinally or axially between the spiral filament sections, and which is capable of making such filament sections with filament wire which is extremely thin, while maintaining high quality and uniformity of the wound filaments.

Briefly, it has been found that the difficulty in utilizing well-known prior art machinery to handle filament wires of tiny diameters, typically below 0.2 mm, and even below 0.05 mm apparently is due to lack of frictional engagement between the core or mandrel wire and roller and the pin, permitting the finer and thinner filament wire to slip between the core wire and the roller or pin, respectively. In accordance with a feature of the invention, a pincer system is provided, in which two jaws, formed with end gripping portions can pinch the core wire, and are moved with the core wire in the direction of transport of the core wire. The spacing of the jaws of the pincer system determines the length of the separating zone or separating section between the spiral filament sections. When the separating zone has been pulled along together with the core wire, with the pincers gripping the core wire, and it is desired again to form the next spiral filament sections, the jaws of the pincer open, the filament wrapping proceeds, and the open jaws are returned to a stop or rest position to permit closing when the required, or commanded number of turns of the spiral filament sections have been wound and to form the subsequent separating zone.

The apparatus has the advantage that rejects upon the manufacture of spirally wrapped filament elements are essentially eliminated, or so low as not to be a significant factor—substantially lower than with prior art machinery. Additionally, and primarily, this can be achieved with filament wire diameters of less than 0.05 mm and up to 0.15 mm. It is also possible to make incandescent filaments with straight separating zones. This is possible with filamentary wires which are as thin as 0.01 mm in diameter, that is, wires which are so thin that they cannot be handled at all with prior art machinery. Filament wires of 0.01 mm to 0.03 mm are used with some new miniaturized incandescent lamp sources.

Filaments of the type which can be made by the machine of the present invention are particularly suitable for miniature incandescent lamps of low power, that is, just a few watts, and of low voltage, in the order of, for example, between 12 and 24 V. Such lamps are used in the automotive field, for example for interior, or panel or special display illumination. Straight separating zones facilitate precise placement of the incandescent filaments in the current supply leads which extend from current supply holders or mounts. Usually, these current supply leads terminate in eyes or hook ends, to which the filament then is secured with a portion of the straight separating zone.

The apparatus is particularly suitable to make single spiral, or coiled filaments, but it is not limited thereto; the machine is also capable of making coiled-coiled filaments, that is, doubly coiled filaments, with straight separating coiled zones.

It has been found, surprisingly, that with heavier filaments which can also be handled with a conventional prior art roller-type machine, the manufacturing speed of the machine of the present invention can be increased by about 10%.

The uniform and higher quality of the filaments, with the separating zones extending essentially axially, is reflected in higher lifetime of the resulting lamp, constant and uniformly reproducible light flux, throughout the lifetime of the lamp, and hence overall longer lifetime of lamps made with filaments on the apparatus of the present application.

DRAWINGS

DETAILED DESCRIPTION

Figure 7:
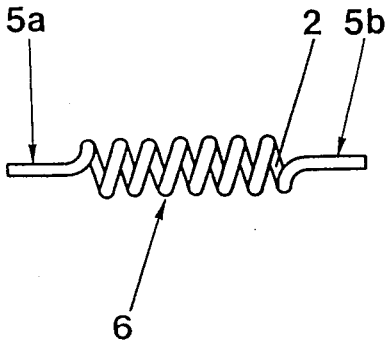
FIG. 7 is a front view of a filament made by the machine of the present invention.

Detailed Description Referring first to FIG. 7: the filament 2 to be made has a spiral filament section 6 and, adjacent each end, a straight section 5*a*, 5*b*. The straight sections 5*a*, 5*b* are severed parts of a separating section or zone 5 (FIG. 1), formed between sequential filaments 2.

The filaments are made on a filament manufacturing wrapping or winding machine, well known in the industry and in the prior art. A typical machine of this type is described, for example, in British Pat. No. 865,896, to which German No. 1 148 326 corresponds. Since this machine is well known in the industry, only as much thereof which is necessary for an understanding of the present invention will be described.

A core wire 4 is delivered from a drum or pay-out reel, not shown, passing through the hollow center of a winding head 1, which terminates in a core wire feed nozzle 3. The winding head 1 carries a supply reel on which the filament wire 2 is spooled, and rotates with the winding head 1. The core wire 4 is supplied from a pay-out reel—not shown—and continuously wound on a pickup reel, not shown. It travels through the winding head 1 and the nozzle 3 at a constant feed speed, as schematically shown by arrow A4. The core wire is held under continuous tension. A plurality of disks are secured on two axially aligned shafts. The second shaft also retains the winding head 1 between the pay-out reel and a wind-up or pickup reel for the core wire, which passes through an axial bore thereof. The disks are used to drive and stop the winding head 1 from rotating. The first shaft including disks D1, D2 can be separated from the second shaft including disk D3 to interrupt drive from disk D1, which is coupled to a continuously rotating motor. A clutch, which may, for example, be a magnetic brake coupling B cooperating with disks D2 and D3, controlled by a coupling and brake control B' and having controlled terminals Ba, controls operation of the second shaft and hence of the winding head 1, that is, rotation, stopping, and braking of the winding head, so that it stops essentially instantaneously, and resumes operation upon engagement of the disks D2, D3. Drive of the disk D1 is schematically indicated by the rotation arrow R', to rotate the winding head as shown by the arrow R, selectively, as determined by the respective magnetic engagement or separation of the disks D2 and D3, as shown by the double arrow.

The supply reel for the filament wire 2, which, typically, is made of tungsten, may be a supply reel which is eccentrically located on the second shaft, or on a winding head 1, or concentrically in connection thereover, with feed of the wire 2 over-head. The feed speed and direction is schematically shown by arrow A2. The winding can be in accordance with any suitable construction used in industry. The present invention can be used in connection with an existing machine.

Figure 1:
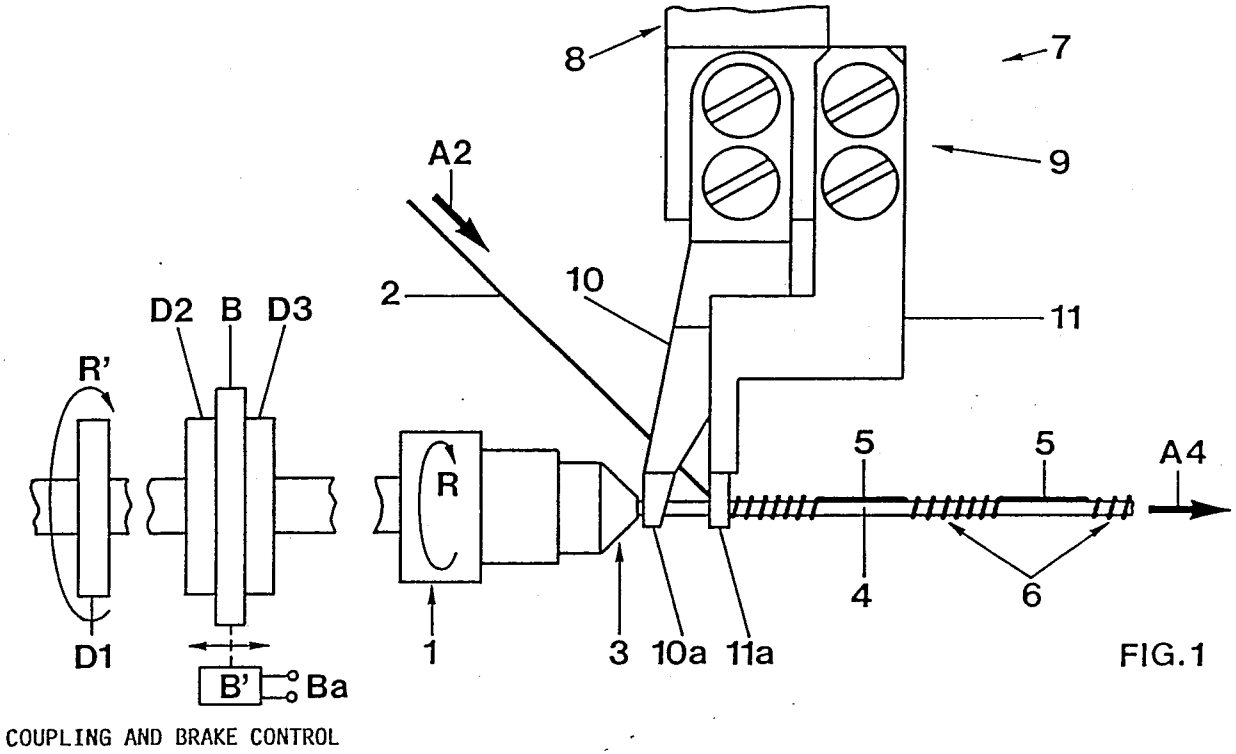
FIG. 1 is a highly schematic fragmentary side view of a wrapping portion of a filament wrapping and winding machine, illustrating the basic parts, and the principle of operation of the apparatus of the present invention.

FIG. 1 schematically shows a side view of the end portion of the winding head 1. The filament wire 2, received from a supply reel, for example over a suitable guide element such as a guide eye or guide roller—not shown—is guided to the core wire nozzle 3, from the axial bore of which the core wire 4 emerges, being held under tension and moved in the direction of the arrow A4. The nozzle 3 maintains the direction and orientation of the core wire 4.

In accordance with the present invention, and to form the separating zones 5 between two spiral filament sections 6, a pincer system 7 is located immediately adjacent, downstream—with respect to the movement of the core wire 4—of the nozzle 3. The pincer system 7 is positioned perpendicularly over the core wire 4. A complete description of the pincer system 7 will be found below, with reference to FIGS. 5 and 6; for the present description and to show the operation, it is necessary only to point out that the pincer system 7 has two jaws 8 which, in the side view of FIG. 1, are positioned behind each other, so that only one of them is visible. The jaws themselves are shown at 8*a*, 8*b* in FIG. 6. The end 9 of each jaw 8 is forked to form two spaced arms 10,11 located along the core wire 4. The spaced arms 10,11 are rigidly connected to the jaw 8,for example by screw connection as shown in FIG. 1. The arms 10,11 terminate in gripping points 10*a*, 10*b*, 11*a*, 11*b*, respectively, made of hard metal, or having hard metal inserts. A suitable hard metal is e.g., Widia type GT 05. FIG. 1 only shows the gripping points 10*a*, 11*a* of the front jaw. The spacing d—see FIG. 3—between the end of the gripping point 10*a* closest to the nozzle 3 and the end of the gripping point 11*a* remote from the nozzle 3 determines the desired length of the separating zone or section 5 between two sequential spiral sections 6. This length is relatively small—in the order of a few millimeters. To provide for the spacing between the arms 10, 11, the rearward arm 11 is offset in Z-shape , as clearly seen in FIG. 1, towards the front arm 10. The hard metal gripping points 10*a*, 10*b*, 11*a*, 11*b* are secured to the arms 10, 11 in a suitable manner, for example by welding, brazing, or the like.

Figure 2:
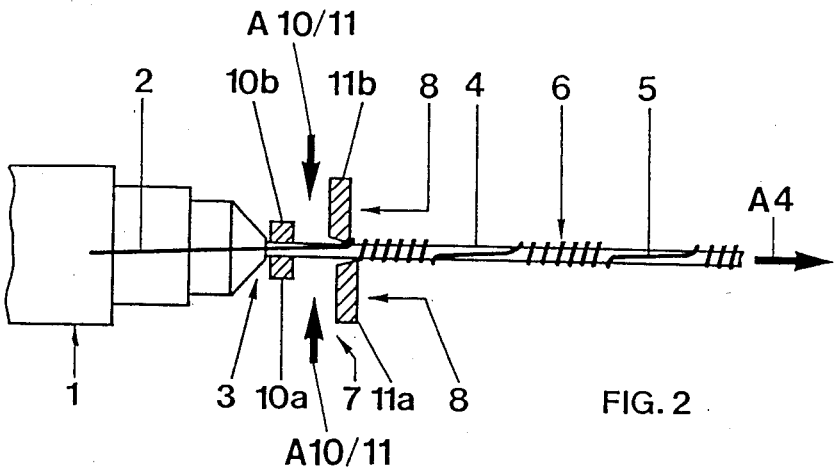
FIGS. 2, 3 and 4 are fragmentary top views of the wrapping machine of FIG. 1, partially cut to illustrate operation of the pincer jaws, and showing sequential operating conditions and steps.
Figure 3:
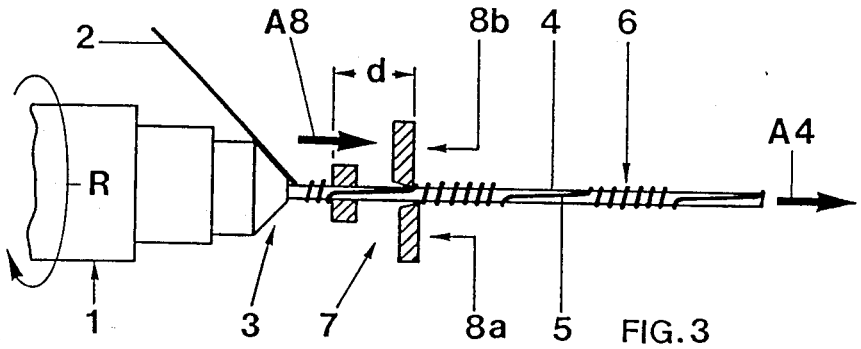
Figure 4:
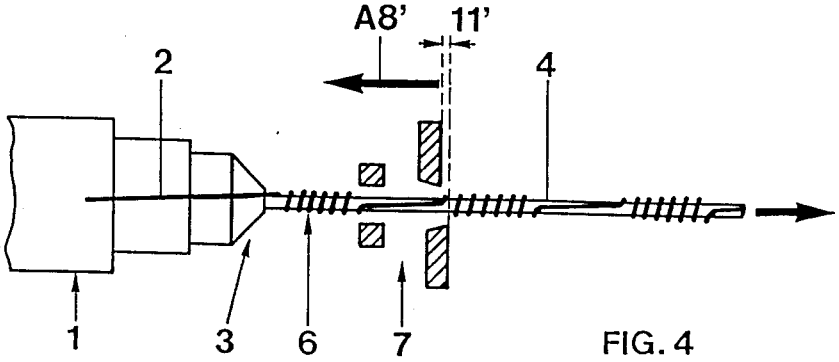

FIGS. 2 to 4 illustrate the arrangement in top view, with only the important elements thereof shown.

FIG. 2 shows the location of the gripping points of the arms 10, 11 and of the filament wire 2 immediately in advance of making a straight separating section.

The gripping points 10*a*, 10*b* are located immediately in advance of the nozzle 3, the gripping points 11*a*, 11*b* being spaced therefrom in accordance with the length of the separating zones 5. The gripping points 10*a*, 10*b*, 11*a*, 11*b* have just closed, see arrows A10/11 . The core wire 4 thus is clamped between the jaw gripping points 10*a*, 10*b* of the forward arms 10, as well as between the clamping points 11*a*, 11*b* of the rearward arms 11. The filament winding wire 2, with the winding head 1 being stationary, is positioned roughly perpendicularly above the core wire 4. To ensure that all four gripping points 10*a*, 10*b*, 11*a*, 11*b* simultaneously engage the core 4, it is particularly advantageous and preferred to form the rearward pair of arms 11 with resilient or spring elements. Due to the unavoidable manufacturing tolerances, simultaneous engagement of four clamping points can be obtained with stiff arms only very expensively, particularly since the dimensions of the respective elements are such that handling of materials and elements becomes difficult.

The gripping points 11*a*, 11*b* of the rearward pair 11 are offset with respect to each other by a half pitch of the spiral of the filament section 6. This permits engagement of the gripping points 11*a*, 11*b* immediately adjacent the end of the last wrapped spiral section 6. Upon closing of the jaws 8, the gripping point 11*b* pushes the filament wire, in the level of the end facing the supply reel of the last made filament spiral section 6 in the direction of the core wire 4 and thus forms a sharply angled starting region of the next separation.

Closing of the jaws 8 is preferably synchronized with the starting and stopping of the rotary movement of the winding head 1, see arrow R, FIG. 3. This permits simple parallel connection of electrical control of the closing of the jaws and of winding operation. It is not necessary, however, that this operation is strictly synchronous; the jaws 8 must be closed the latest when the winding head 1, upon beginning of rotation, has rotated about 90°. This is referred to as a startdelayed operation.

After a quarter revolution—90° rotation—of the winding head, the filament winding wire 2 engages the gripping points 11*b* and 10*a* independently of the closing of the jaws 8 and forms between the two gripping points the next straight separating section 5. Continued rotation of the winding head 1—see FIG. 3—forms between the gripping point 10*a* and the run-off of the filament wire 2, now wrapping itself about the nozzle 3 and the core wire 4, the next filament section 6, engagement with the gripping point 10*a* forming a right angle between separating zone 5 and the start of the next spiral section 6.

Further continued rotation of the winding head 1—and of the filament wire fed from the supply reel—results in manufacture of the next filament section. The filament wire 2 is guided, as well known, by the conical end of the nozzle 3. The pincer system 7 remains closed, and, due to its clamping force, the jaw pair 8 is carried along by the core wire 4, see arrow A8. Continued feed of the core wire 4, see arrow A4, due to tension from the wind-up drum (not shown), causes the jaws to move in the direction of the arrow A8. The pincer system 7 is deflected during this cycle of operation from a quiescent condition. The pincer system 7 holds the jaws in engagement until the new filament spiral section 6 is made.

As soon as the requisite number of turns 6 have been wound on the core wire 4—for example as determined by a counter coupled to count revolutions of the winding head 1, the winding head 1 is braked. This can be accomplished, for example, by separating the disks D2,D3—FIG. 1—and by stopping disk D3 by suitable control to the controlled terminals Ba. The core wire 4 continues to be fed in axial direction, see arrow A4, so that the next separating section or zone 5 can be formed. The pincer system 7, immediately or with slight delay, is opened and snaps back to its starting position immediately in advance of the nozzle 3, as shown by arrow A8'. The relative length of the arrows A8 and A8' schematically indicates the difference in speed, with the arrow A8' being substantially larger, to symbolize the faster return movement of the jaws 8. In the starting position of the pincer system 7, that is, immediately in advance of nozzle 3, the pincer system 7 again closes and the cycle can repeat, see FIG. 2.

The offset of the gripping points 11*a*, 11*b* is only shown in FIG. 4, schematically at 11', for clarity of illustration. The dimension lines have been omitted from the other drawing.

In this manner, a continuous strand of spiral sections 6 with straight separating zones 5 are formed, made of incandescent filament wire 2, which is wound, in well known manner, on a receiving reel or drum (not shown). In separate steps, and as well known in the prior art, this strand is then annealed to remove stresses therein, the individual filament sections 6 are severed intermediate the separating sections 5 to form the cut sections 5*a*, 5*b*, and the core wire 4 is then removed by etching.

Figure 5:
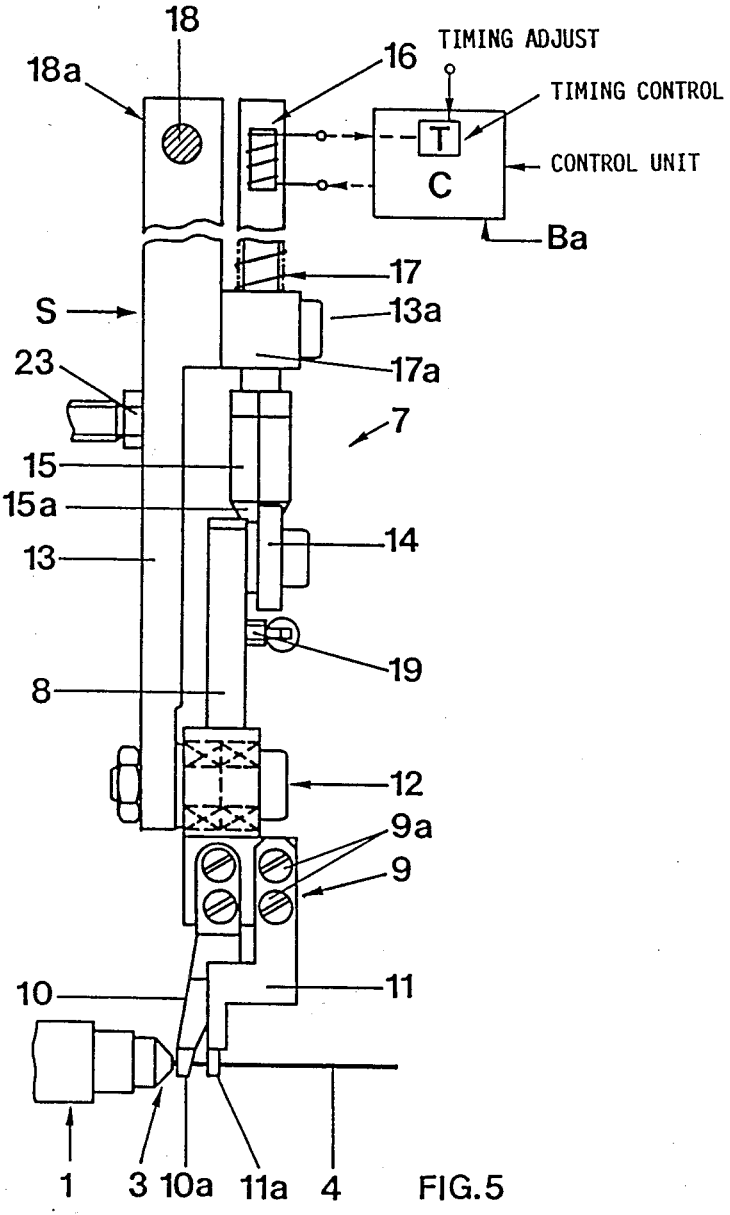
FIG. 5 is a side view of the pincer system, illustrating the portion of the system of FIG. 1, and the overall operating arrangement of the machine.
Figure 6:
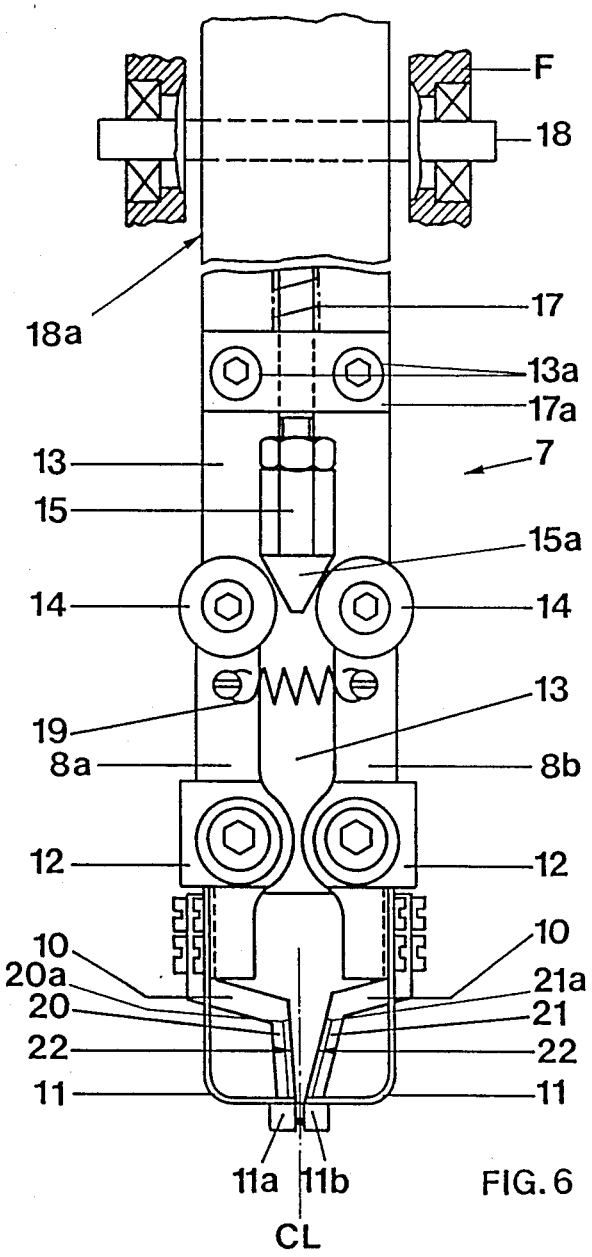
FIG. 6 is a front view of the apparatus of FIG. 5.

Construction of the pincer system 7, with reference to FIGS. 5 and 6

The jaws 8 of the pincer system 7 are symmetrical with respect to each other. The gripper ends 9 of each ones of the jaws 8—as seen in FIG. 1—have the spaced arms 10, 11 secured thereto. Gripper movement of the ends 9 of the jaws 8 is made possible by securing the jaws 8 by a movable joint 12 to a rearwardly located support plate 13. Two rollers 14 are located on the jaws 8 upwardly of the joints 12, and remote from the ends of the jaws 8 adjacent the core wire 4. A push rod 15, having a conical end 15*a* is in engagement with the rollers 14. The push rod 15 is moved downwardly by an electromagnet or solenoid 16 (FIG. 5) that pushes the rod 15 with the conical tip 15*a* downwardly by means of a pressure plate (not shown),, counter the force of the spring 17 wrapped about the upper part of the rod 15, with reference to the direction of FIG. 5. The spring 17 is coupled at its upper end to the rod 15 and its lower end is supported on a guide plate 17*a* (see below). Continued engagement of the rollers 14 of the jaws 8 on the conical tip 15*a* of the rod 15 is obtained by a cross-connecting spring 19 (FIG. 6).

The duration of a cycle, that is, opening and closing of the pincer system 7, can be controlled between 10 milliseconds and 200 milliseconds.

A control system C, including a timing adjust control T, receives signals, and also controls the brake control Ba. In the simplest manner, opening and closing of the jaws 8 is obtained by coupling the electromagnet 16 directly to the terminals Ba, of the brake magnet coupling of the winding head 1. However, and in accordance with a preferred feature of the invention, the opening and closing of the jaws can be delayed at the closing, and opening conditions, respectively, by suitably adjusting the timing control by a timing adjustment control signal—for example a dial setting—so that more time for moving the jaws 8 of the pincer system 7 will become available.

The pincer system 7 is rotatable around a suspension shaft 18, secured in a bore of an extension 18*a* of the carrier plate 13, the shaft 18 being located precisely above the exit opening of the winding nozzle 3. The carrier plate 13 is retained on the machine by a suitable support frame F which can be of any well-known and standard construction. The bore of a guide plate 17*a* held to plate 13 by screws 13*a* guides the push rod 15.

In the quiescent, or starting position of the pincer system 7, the gripping points 10*a*, 10*b* of the forward arms 10 are arranged directly in advance of the winding nozzle 3. The gripping points 11*a*, 11*b* of the rearward arms 11 are spaced by the distance d from the arms 10, and corresponding to the length of one separating zone.

Actually,and precisely, this spacing is true only for one of the rearward points, namely the gripping point 11b—see FIG. 3, the gripping point 11a being offset by spacing 11' with respect to gripping point 11b- FIG. 4.

Operation

After closing of the jaws 8, the pincer system 7 is carried along in the direction of the arrow A4 by the engagement force of the jaws on the core wire 4. Actually, the pincer system rotates about the axis of rotation of the shaft 18 . The deflection of the pincer system 7 from the quiescent position is so small; it is in the order of a few millimeters, and corresponds to the length of a filament spiral section 6, compare FIGS. 2 and 4. The spacing between the gripping points 10a, 10b and the rotation axis 18 ,however, is substantially more, typically about 15 cm, so that the difference between rotary movement about axis 18 and longitudinal movement of the core wire 4 becomes negligible, and, actually, the deflection of the gripping points 10a, 10b is an effective approximation of the linear movement of the core wire 4. This arrangement surprisingly eliminates a separate drive—known in the prior art—for the pincer system 7, which not only results in substantial simplification, and hence a cheaper construction, but also eliminates problems of synchronization of the jaw movement with respect to core wire movement. In accordance with a preferred feature of the invention, the movement of the pincer system during its clamped condition at the core wire is preferably assisted by a spring, schematically shown by the spring force vector arrow S (FIG. 5), so that the wind-up force exerted by the wind-up drum, and causing the movement in the direction of arrow A4 of the core wire is unloaded. The spring , providing the spring force S, can be secured, for example, to the extension 18a of the support plate 13 and supported for force acceptance on the carrier frame or other support structure, and are not shown. In the quiescent position of the pincer system 7, the force S is being applied, that is, a tension spring would be tensioned, so that it can relax during movement of the pincer system 7 in the direction of the arrow A4 (FIG. 1).

After opening of the jaws 8, in the position of maximum deflection (see FIG. 4), the pincer system 7 swings back into the quiescent position, shown in FIG. 2, due to its own weight. The stop position in which the jaws 10 are adjacent to winding head nozzle end 3 can be set in a reproducible manner by a stop 23 (FIG. 5) of the carrier frame, with the spring providing the force S having a damping function.

The pincer system itself is best seen in FIG. 6, which also clearly shows the detailed construction of the arms 10, 11. The forward arms 10 are inwardly offset; the legs 20, 21 of the offset portion adjacent the gripping ends are inclined with respect to each other and an axis of symmetry or center line CL. The angle of inclination of the legs 20, 21 with respect to the vertical center line CL is different in the two forward arms 10. This is done to permit freedom of movement of the filament wire 2 between the forward arms 10 upon rotary movement of the winding head 1. The facing inner surfaces 22 of the legs 20, 21 are reinforced with hard metal inserts, for example of the type Widia of the type GT 05, in order to counteract frictional wear upon engagement with the rotating filament wire 2. These hard metal inserts are shown schematically in FIG. 6 at 20a, 21a, and have been omitted from the other figures for clarity.

The rearward arms 11 are made of hardened strip spring steel. They are bent inwardly at their lower ends. The arms 11 of both jaws 8 are symmetrical with respect to each other. In the direction of movement of the core wire 4, the arms are offset with respect to each other, see dimension 11', FIG. 4. This offset is tiny. When making an incandescent filament as shown in FIG. 7, the offset is only 0.022 mm.

The length of the separating zone or section 5 is controllable within some limits, for example ±1.5 mm. This can be obtained by placing the arms 11 on the ends 9 of the jaws 8 with screws 9a—FIG. 5—which are engaged in elongated holes. The elongated holes are not visible, since the screw heads cover the entire elongation.

The designation "forward arms" and "rearward arms" relates to the position relative to the winding nozzle 3. It is to be noted that the view of FIG. 6 is from the take-up reel, and is counter the direction of the winding nozzle, and shows the "rearward arms" 11 in front of the "forward arms" 10.

The incandescent filament shown in FIG. 7, and made by the apparatus of the present application has a filamentary wire of 0.024 mm diameter. The core wire has a diameter of 0.09 mm, so that the outer diameter of the primary winding of the filament will be 0.138 mm. The pitch, determined by the feeding speed of the core wire is 0.044 mm, corresponding to a spacing of 0.02 mm between adjacent windings of the spiral section 6 of the filament. The straight separating zones 5a, 5b, after cutting, will be about 2 mm.

Filaments of this type are particularly suitable for low voltage, between 12 and 24 V, and low power, to provide miniaturized incandescent lamps, particularly for vehicular and especially for automotive use.

Various changes and modifications may be made within the scope of the inventive concept.

I claim:

1. Machine for sequential manufacture of incandescent lamp filaments, in which a filament wire (2) is wrapped around a core wire (4) to form spiral filament sections (6);

said machine having a frame (F);

means for supplying the filament wire;

a rotatable winding head (1) guiding the filament wire to the core wire (4) and wrapping the filament wire (2) about the core wire;

a core wire guide nozzle (3) maintaining the core wire on the axis of rotation of the winding head;

means for moving the core wire (4) axially through the winding head in a predetermined direction with essentially uniform speed; and means for forming essentially straight axially extending separating zones (5) of filament wire (2) between two sequential wrapped filament sections (6) comprising a pincer system (7) having two jaw means (8, 8a, 8b), each formed with end portions (9) movable essentially along said axis;

said core wire guide nozzle (3) guiding the core wire (4) between the end portions (9) of the jaw means;

operating means (14–19) coupled to said jaw means for selectively closing the end portions of the jaw means against the core wire, and opening the end portions of the jaw means for spacing them from the core wire; and wherein said pincer system (7) comprises a shaft (18) spaced by a distance from the core wire (4) which distance is large with respect to the length of said separating zones (5) said shaft pivotably supporting the jaw means (8) on the frame about an axis of rotation substantially perpendicular to the axis of the winding head, said end portions, upon closing against the core wire, being carried along by the core wire; and wherein the end portion (9) of each jaw means (8) of the pincer system (7) comprise two arms (10, 11) relatively positioned longitudinally along the core wire (4).

2. The machine of claim 1, further including resilient force biassing means (S) providing a biassing force in the direction of movement of said core wire (4) and applied to said pincer system (7) to assist movement of the jaw means (8) in the direction of movement of the core wire.

3. The machine of claim 1, wherein the axis of rotation of said shaft (18) and the exit opening of the core wire guide nozzle (3) are located essentially in a common plane transverse to said axis of rotation of the winding head (1).

4. The machine of claim 1, wherein said pincer system (7) includes a support element (13) supporting said jaw means (8), said shaft (18) being located spaced from the core wire by a distance substantially in excess of the length of said separating zones (5) and resulting in essentially equality of angular movement of the jaw means engaging the core wire,upon pivoting of said support element about said shaft,with the linear movement of the core wire.

5. The machine of claim 1, wherein said pincer system includes a support plate (13) supporting the jaw means (8); and movable joint or pivot means (12) pivotably supporting the jaw means (8) on the support plate (13) to provide for opening and closing of the end portions of the jaw means upon pivoting thereof.

6. The machine of claim 5, wherein said operating means further includes a reciprocating push element (15) formed with a conical tip (15*a*), said conical tip being engageable between said jaw means (8) at a position remote from said pivot means (12) and said core wire (4) to, respectively, control opening and closing movement of said jaws against the core wire.

7. The machine of claim 6, wherein said conical tip (15*a*) is engageable between rollers (14) arranged at the ends of the jaw means (8) remote from the core wire (4).

8. The machine of claim 6, including electromagnetic means (16, C) coupled to said push element (15) for operating it in a reciprocating movement.

9. The machine of claim 1, wherein the arms (10, 11) are formed with gripping points (10*a*, 10*b*; 11*a*, 11*b*) comprising hard metal.

10. The machine of claim 1, wherein the ends of the arms (10, 11) are formed with gripping points (10*a*, 10*b*; 11*a*, 11*b*);

and wherein the spacing (d) between two staggered gripping points (10*a*, 11*a*; 10*b*, 11*b*) of at least one jaw (8*b*) corresponds to the length of the separating zone (5).

11. The machine of claim 1, wherein the arms (10*a*, 10*b*) adjacent the core wire guide nozzle (3) are inwardly offset elements defining inwardly located leg portions (20, 21), said leg portions being inclined with respect to a vertical center line (CL) passing through the axis of the core wire.

12. The machine of claim 11, wherein the facing inner surfaces (22) of the legs (20, 21) are reinforced by hard metal reinforcing plates (20*a*, 21*a*).

13. The machine of claim 1, wherein the arms (10, 11), in the direction of movement of the core wire, are longitudinally offset with respect to each other by a spacing (11') corresponding to half a pitch of the spiral of the spiral section of the filament (6) in the region of engagement of the respective arm with the core wire.

14. The machine of claim 1, wherein the operating means (14–19) comprise means (19) for closing the end portions (9) of the jaw means against said core wire (4) and means (14–18) for separating the end portions (9) of the jaw means (8) from the core wire;

said shaft (18) movably supporting the pincer system (7) on said frame (F) so that the jaw means will be carried along by said core wire for a limited distance when the end portions of the jaw means are closed against the core wire during winding of the spiral filament section about the core wire, said operating means opening the end portions of the closed jaw means after the pincer system (7) has traveled with the spiral filament section, for return movement to an initial or rest position, said return movement being at a rate of speed faster than the travel or transport speed of said core wire (4) in said direction; and means (C, T) for controlling the relative timing of the opening of the end portions of the jaw means and rotation or stopping of the winding head.

15. The machine of claim 1, further including means (D1) for rotatably driving said winding head (1);

a brake and coupling element (D2, B, D3) interposed between said rotatable driving means and the winding head;

electrically controlled operating means (16) coupled to the pincer system (7) for controlling, selectively, opening and closing of the jaw means; and means (B', C) for controlling operation of said electrical operating means (16) and said brake and coupling element (D2, B, D3) in synchronism to synchronously operate the jaw means and control rotation of said winding head.

16. The machine of claim 1, further including means (D1) for rotatably driving said winding head (1);

a brake and coupling element (D2, B, D3) interposed between said rotatable driving means and the winding head;

electrically controlled operating means (16) coupled to the pincer system (7) for controlling, selectively, opening and closing of the jaw means;

and means (C) including timing means (T) for controlling operating of said electrical operating means (16) and said brake and coupling element (D2, B, D3) in accordance with predetermined timed relationships to control, respectively, operation of said winding head and said electrical operating means in synchronism, or with selected time differences.

17. The machine of claim 1, further including means (D1) for providing rotary power for said winding head;

a first hollow shaft coupled to said power providing means;

a first coupling element (D2) secured to said first shaft;

a second hollow shaft in alignment with said first hollow shaft, said second hollow shaft carrying said winding head (1);

a second coupling element (D3) secured to said second hollow shaft;

the core wire (4) being guided through said first and second hollow shafts;

a coupling and brake element (B) interposed between said first and second coupling elements;

and means (B') for controlling the coupling and brake element (B) for, selectively, rotating and stopping the winding head (1) by, respectively, establishing a drive connection between said power providing means (D1) and the winding head (1) through said coupling elements or, selectively,disconnecting said driving connection and braking said winding head.

18. The machine of claim 1, wherein the pincer system (7) includes a common support element (13, 18*a*) for said jaw means (8);

said shaft (18) passing through an opening in the support element and being located above the core wire by said large distance.

19. The machine of claim 18, wherein the axis of rotation of said shaft (18) and the exit opening of the core wire guide nozzle (3) are located essentially in a common plane transverse to said axis of rotation of the winding head (1);

wherein the common support element (13, 18*a*) is freely swingable about said shaft (18) to provide for return, by gravity, of the jaw means (8) to a position essentially in said plane upon opening of the end portions (9) of the jaw means and after having been carried along by said core wire (4) when the end portions of the jaw means were closed against the core wire.

20. The machine of claim 18, wherein said common support element (13, 18*a*) forms a single support element for both said jaw means (8); and wherein the arms (10, 11) of the jaw means are spaced from each other, in a dimension along said core wire (4) by a fixed predetermined distance.

21. The machine of claim 1, wherein the arms (10, 11) of the jaw means are moved, conjointly, along the core wire by said core wire upon engagement of the end portions (9) of the jaw means against the core wire;

and said arms are returned to an initial position, after having been moved by said core wire, by gravity.

22. Machine for sequential manufacture of incandescent lamp filaments, in which a filament wire (2) is wrapped around a core wire (4) to form spiral filament sections (6);

said machine having a frame (F);

means for supplying the filament wire;

a rotatable winding head (1) guiding the filament wire to the core wire (4) and wrapping the filament wire (2) about the core wire;

a core wire guide nozzle (3) maintaining the core wire on the axis of rotation of the winding head;

means for moving the core wire (4) axially through the winding head in a predetermined direction with essentially uniform speed; and means for forming essentially straight axially extending separating zones (5) of filament wire (2) between two sequential wrapped filament sections (6) comprising a pincer system (7) having two jaw means (8, 8*a*, 8*b*), each formed with end portions (9) movable essentially along said axis;

said core wire guide nozzle (3) guiding the core wire (4) between the end portions (9) of the jaw means;

operating means (14–19) coupled to said jaw means for selectively closing the end portions of the jaw means against the core wire, and opening the end portions of the jaw means for spacing them from the core wire; and wherein each jaw means of said pincer system (7) comprises two arms (10, 11) mounted on said end portion and relatively positioned longitudinally along the length of the core wire;

means (13) for supporting said two arms at said position along the length of the core wire, said relative positions defining the length of the separating zones (5) of the filament wire and being invarying;

means (18) movably supporting said support means (13) on the frame (F); and control means (C) coupled to and controlling the operating means (14-19) for controlling winding of the filament wire (2) about the core wire (4) and for controlling closing of the end portions (9) of the arms of the jaws against said core wire and, selectively, separating the end portions of the jaws from the core wire, so that the jaws will be carried along by the core wire for a limited distance when the end portions of the jaw means are closed against the core wire during winding of the spiral filament section about the core wire, as well as during movement of the core wire without winding of the filament wire thereabout, said operating means opening the end portions of the closed jaw means after the pincer system has traveled with the spiral filament section, for return movement of the jaws to an initial or rest position.

23. The machine of claim 22, wherein the return movement is at a rate of speed faster than the travel or transport speed of said core wire (4) in said direction.

24. The machine of claim 22, further including means (D1) for rotatably driving said winding head (1);

a brake and coupling element (D2, B, D3) interposed between said rotatable driving means and the winding head;

electrically controlled operating means (16) coupled to the pincer system (7) for controlling, selectively, opening and closing of the jaw means; and means (B', C) for controlling operation of said electrical operating means (16) and said brake and coupling element (D2, B, D3) in predetermined time relation for selectively opening and closing the jaws on the core wire and rotating, or stopping rotation of the winding head.

25. The machine of claim 1, wherein the arms (10, 11) remote from the core wire guide nozzle (3) are resilient.

26. The machine of claim 25, wherein said arms are bent inwardly towards each other and towards the core wire.

* * * * *